US005163891A

United States Patent [19]

Goldsborough et al.

[11] Patent Number: 5,163,891

[45] Date of Patent: Nov. 17, 1992

[54] BOX FORMING MACHINE HAVING A VACUUM BELT TOP CONVEYOR

[75] Inventors: Stanley D. Goldsborough, Bel Air; Anthony P. Kaminski, Manchester, both of Md.

[73] Assignee: Langston Staley Corporation, Hunt Valley, Md.

[21] Appl. No.: 810,947

[22] Filed: Dec. 19, 1991

[51] Int. Cl.[5] ..... B31B 1/14; B31B 1/88

[52] U.S. Cl. ..... 493/321; 493/55; 493/64; 493/324

[58] Field of Search ..... 493/53, 55, 64, 320, 493/321, 324, 341, 370

[56] References Cited

U.S. PATENT DOCUMENTS

| | | | |
|---|---|---|---|
| 2,905,309 | 9/1959 | Makrides . | |
| 3,202,302 | 8/1965 | Insolio . | |
| 3,240,491 | 3/1966 | Buccicone . | |
| 3,270,602 | 9/1966 | Kirby et al. | 493/370 |
| 3,304,508 | 12/1967 | Wolf . | |
| 3,359,648 | 12/1967 | Overly et al. . | |
| 3,375,917 | 4/1968 | Irving . | |
| 3,477,558 | 11/1969 | Fleischauer . | |
| 3,608,895 | 9/1971 | Kalven . | |
| 3,827,548 | 8/1974 | Matsuo . | |
| 3,889,801 | 6/1975 | Boyer . | |
| 3,915,085 | 10/1975 | Lehman . | |
| 3,958,684 | 5/1976 | Schregenberger . | |
| 3,963,235 | 6/1976 | Snellman et al. . | |
| 4,291,974 | 9/1981 | Silverberg . | |
| 4,294,539 | 10/1981 | Spehrley, Jr. . | |
| 4,295,734 | 10/1981 | Silverberg . | |
| 4,406,359 | 9/1983 | Cole et al. . | |
| 4,480,742 | 11/1984 | Muylle . | |
| 4,618,342 | 10/1986 | Borel | 493/30 |
| 4,642,085 | 2/1987 | Helm . | |
| 4,645,069 | 2/1987 | Sjogren . | |
| 4,773,522 | 9/1988 | Lenhart . | |
| 4,981,206 | 1/1991 | Franklin . | |
| 5,026,249 | 6/1991 | Shill . | |

OTHER PUBLICATIONS

Article in the Oct. 1991 edition of the Paperboard Packaging Magazine (p. 31) making reference (col. 1 bottom—col. 3 top) to a drying section of United Container Machinery Group Inc.

Brochure of United Container Machinery Inc. describing their GRAPHIXMASTER printing press.

*Primary Examiner*—William E. Terrell

*Attorney, Agent, or Firm*—Seidel, Gonda, Lavorgna & Monaco

[57] ABSTRACT

A machine for forming a box without smearing or distorting its printed matter. The machine has a feed section at its input stage, a stacking section at its output stage, and print, dryer, and die cutter sections at its intermediate stages. The dryer section has an overhead vacuum conveyor for moving box blanks from the print section to the die cutter section. The die cutter section for forming the cutouts in the box has a first and a second roller, with the first roller having an extension and the second roller means having a soft surface to allow the extension to penetrate, thus cutting the box. The drying operation is performed without causing any smearing of the printed matter and, similarly, cutouts are formed without causing any distortion of the printed matter, all being accomplished while the box blank moves along its predetermined path within the box forming machine.

9 Claims, 4 Drawing Sheets

BOX FORMING MACHINE HAVING A VACUUM BELT TOP CONVEYOR

FIELD OF THE INVENTION

The present invention relates to a box forming machine, and more particularly, to a box forming machine that places printed matter on the box without having the printed matter smeared or distorted by any drying or cutting process, respectively, within the machine.

BACKGROUND OF THE INVENTION

Box forming machines commonly include a printer station for placing printed information on a blank that is used to form the box. The printing station is commonly upstream from a dryer station that uses hot air to dry the printed matter before the blank sequences to other operational stations. The blank is commonly moved within the dryer station by feed belts or rollers that come into contact with the box blank and sometimes cause the printed matter, while in its wet state, to become smeared. It is desired that means be provided to eliminate any smearing of the printed matter on the box blank during its movement within the dryer station.

A die cutting station is commonly placed downstream of the dryer, and removes portions of the box blank so that the remaining voids form hand holes, tabs and the like in the box blank. For aesthetic reasons, it is desired that the printed matter on the box not be distorted by any cutting process so that the printed matter may present a clear, clean presentation to an observer.

The box forming machine should be able to produce various boxes each having different styles, and each having different dimensions, such as width and thickness. It is desired that the box forming machine be provided with means to accommodate the various and changeable dimensions of the box.

Accordingly, it is an object of the present invention to provide a box forming machine having means to accommodate variable dimensions associated with different types and styles of boxes.

It is a further object of the present invention, to provide a box forming machine having means for placing printed matter on a box blank, and for forming cutouts in the box blank, without causing any distortion of the printed matter.

Further still, it is an object of the present invention, to provide means that prevents the smearing of the printed matter that might otherwise occur when the box blank is conveyed within its drying station.

SUMMARY OF THE INVENTION

The present invention is directed to a system that provides for the forming of a box in which the printed matter is not smeared nor distorted by related drying and cutting processes.

The system comprises means for moving a blank along a predetermined path, used to form a box, means for placing printed matter on the bottom surface of the blank, means for attracting the top surface of the blank to an overhead conveying means, and means for forming cutouts in the box. The means for attracting comprises a source of vacuum that is in communication with and holds the top surface of the blank against the overhead conveying means. The means for forming cutouts in the blank comprises a first and a second roller means, with the first roller having an extension for cutting into the box, and the second roller having a soft surface to allow the extension to penetrate, thus cutting the box. The machine forms a box that is devoid of any smearing or distortion of its printed matter that might, without the benefits of the present invention, otherwise occur during the drying and cutting operations of the machine.

Other objects, advantages and novel features of the present invention will become apparent from the foregoing detailed description of the invention when considered in conjunction with the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
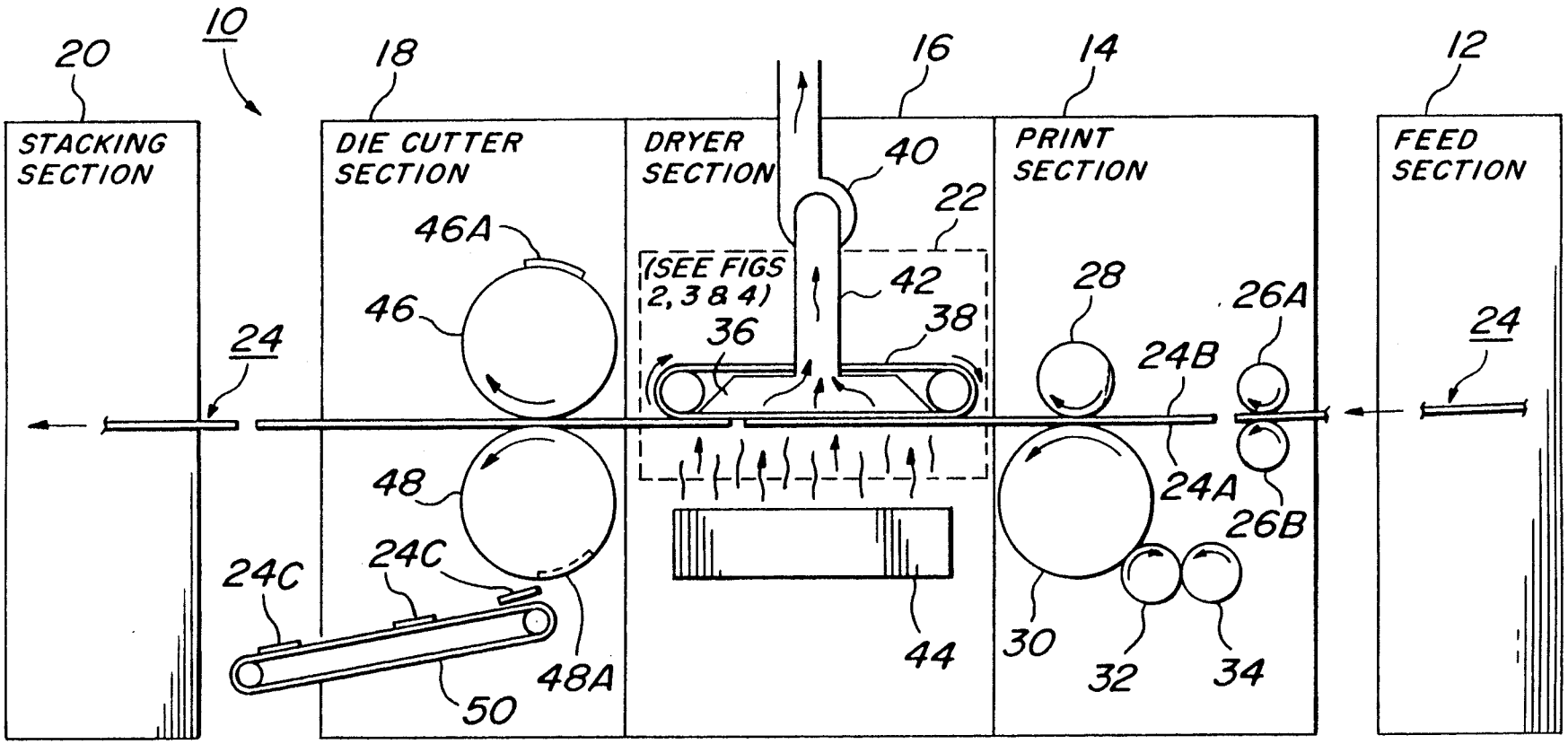
FIG. 1 is a functional representation generally showing the essential operations related to the present invention.

The present invention is directed to a system 10 that forms an integral part of a box forming machine (not completely shown) and provides for the placement of printed matter on the box that is not smeared or distorted during the drying and cutting operations of the box forming machine.

The system 10 is interrelated to the operations being performed in the box forming machine by the feed section 12, the print section 14, the drying section 16, the die cutting section 18, and the stacking section 20. The system 10 further includes a vacuum belt top conveyor that assists in the movement of a blank 24 along a predetermined path within the box forming machine, especially within the dryer section 16. The print station 14, dryer station 16, and die cutter station 18 each comprises elements respectively given in Tables 1, 2, and 3.

TABLE 1

| Element | Nomenclature |
|---|---|
| 26A | pull roller rotating in a clockwise direction |
| 26B | pull roller rotating in a counter-clockwise direction |
| 28 | impression roller rotating in a clockwise direction |
| 30 | print roller rotating in a counter-clockwise direction |
| 32 | ink roller rotating in a clockwise direction |
| 34 | doctor roller |

TABLE 2

| Element | Nomenclature |
|---|---|
| 22 | vacuum belt top conveyor comprising chamber 36 and drive belt 38 |
| 40 | source of vacuum |
| 42 | vacuum duct means |

TABLE 2-continued

| Element | Nomenclature |
|---|---|
| 44 | heat source for drying |

TABLE 3

| Element | Nomenclature |
|---|---|
| 46 | cutting die roller having extension 46A and rotating in a clockwise direction |
| 48 | anvil roller having covers 48A and rotating in a counter-clockwise direction |
| 50 | waste conveyer |

In general, the blank 24, that is used in the formation of the box, is moved along a predetermined path within the box forming machine. The blank enters the machine by way of a downstream feed section 12. The box blank 24 is then sequentially moved along its predetermined path, that is, through the print section 14 wherein printed matter is placed thereon, through the dryer section 16 wherein the printed matter is dried, through the die cutter station 18 wherein cutouts, such as hand holds, are formed in the box blank, and into a stacking section 20 wherein the box is stacked, finally exiting the box forming machine.

The print section 14 has pull rollers 26A and 26B which accept the box blank 24, and continue its movement into and between the impression roller 28 and the printer roller 30. The impression roller 28 contacts the upper surface of box blank 24, whereas the printer roller 30, which does the actual printing, contacts the bottom surface of box blank 24. The printer roller 30 cooperates with an ink roller 32 which, in turn, cooperates with a doctor roller 34 so that associated and predetermined printed matter is placed on the bottom surface 24A of the box blank 24. The box blank 24, having printed matter on its bottom surface 24A, is moved out of printer station 14, and unto dryer section 16 by means of the counter-rotating impression roller 28 and printer roller 30.

The dryer section 16 has the vacuum belt top conveyor 22 which attracts the top surface 24B of the blank 24 so that it comes into and remains in contact with the overhead conveyor belt 38 The conveyor belt 38 continues the movement of the box blank 24 along its predetermined path, while at the same time allows the heat from source 44 to come into contact with the bottom surface 24A so that the printed matter is substantially dry before it leaves the dryer section 16 on its way to the downstream die cutter station 18.

The die cutting section 18 comprises cutting die roller 46 and anvil roller 48 which come together so as to form cutout hand holes, tabs, and the like in the box blank 24. The cutting die 46 contacts the top surface 24B of the box blank, whereas the anvil roller contacts the bottom surface 24A of the box blank 24. The cutting die 46 has an extension 46A which comes down onto the top surface 24B where it mates with the anvil 48 which provides a solid support surface directly positioned under the bottom surface 24A of the box blank 24. The cutting die roller 46 has the extension 46A which has a shape which corresponds to the desired shape of the cutout being formed, whereas the anvil roller 48 has a soft surface, commonly provided by removable covers, to allow penetration of the extension 46A. The counter-rotating cutting die roller and anvil roller move the box blank 24, having the cutout 24C removed onto conveyor 50, into the stacking section 20, wherein a stack of boxes is formed. The stacked boxes are moved on and later exit the box forming machine.

The present invention is particularly suited for providing a box in which its printed matter is not smeared during its drying process, nor is the printed matter distorted during its die cutting process. Further, the present invention provides these non-smearing, non-distortion features while at the same time accommodating different types and styles of boxes having various dimensions.

In general, the present invention advantageously places the printed matter on the bottom surface 24A of the box blank 24, moves printed matter through the drying station without causing any smearing thereof, and places the bottom surface 24A of the box blank into the die cutting station so that any formed cutouts do not distort the printed matter, thereby, allowing aesthetically pleasing printed matter to be presented to an observer. The features of the present invention which allow for the non-smeared, non-distorted printed matter may be further described with reference to FIG. 2.

Figure 2:
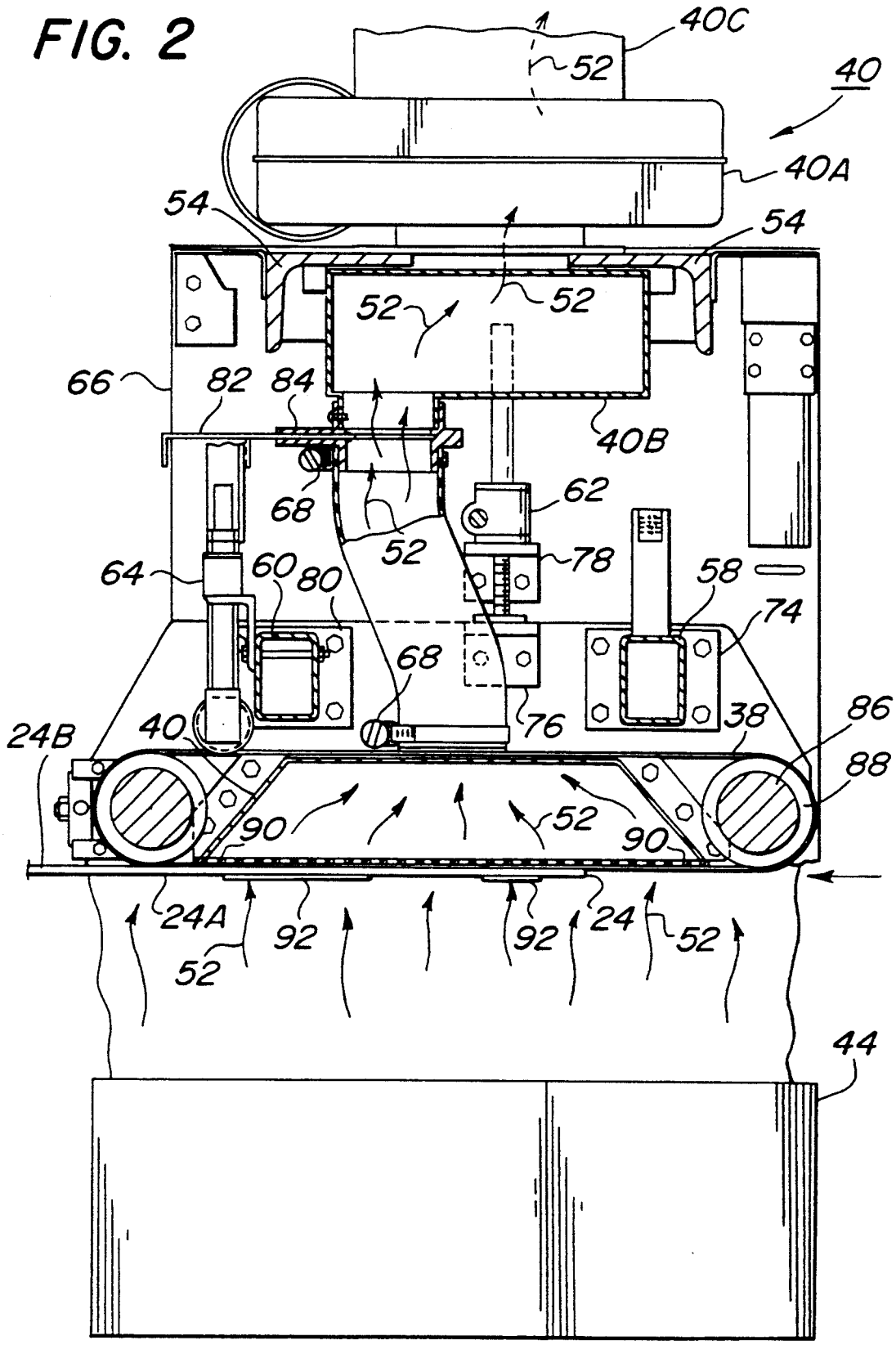
FIG. 2 illustrates details of the vacuum belt top conveyor related to the present invention.

FIG. 2 primarily illustrates a source of vacuum 40 and the vacuum belt top conveyor 22. The source of vacuum 40 comprises a blower 40A, an air chamber 40B, and ventilation means 40C for removal from the box forming machine. The blower 40A evacuates the air chamber 40 allowing the chamber 40 to serve as a source of vacuum which draws air thereto. The drawn air is re-directed onto the ventilation means 40C for removal from the box forming machine. FIG. 2 further shows a plurality of elements that are given in Table 4.

TABLE 4

| Element | Nomenclature |
|---|---|
| 54, 58 and 60 | cross ties |
| 62 | height adjustment means for vacuum belt top conveyor |
| 64 | mounting bracket |
| 66 | frame member |
| 68 | clamping members |
| 74, 76, 78 and 80 | lock plates |
| 82 | slidable air blocking means |
| 84 | guide and support means for element 82 |
| 86 | drive shaft for belt 38 |
| 88 | coupling means between shaft 86 and belt 38 |
| 90 | passageways of chamber 36 |
| 92 | printed matter on bottom surface 24A |

The vacuum within air chamber 40B cooperates with the chamber 36, having passageways 90 on its bottom section, so as to provide vacuum communication between the top surface 24B of the blank 24 and air chamber 40B.

The source of heat 44 emits warm air, as shown as arrows 52, that is forced upward by a blower (not shown). This warm air 52 intercepts, comes into contact with and provides a drying affect to the printed matter 92. Simultaneously, the warm air 52 is drawn into chamber 36 by way of passageways 90. The chamber or housing 36 has connected to its top section, by means of clamp 68, a first end of the conveying duct 42 which has its second end connected, by means of another clamp 68, to the guide and support 84.

The operation of the slidable air blocking means 82, positionable within guide and support 84, either prevents (closed position) air from leaving chamber 36

(more particularly, duct 42 which cooperates with chamber 36), or allows (opened position) the air 52 to exit from duct 42 of chamber 36 and flow into air chamber 40B which, in turn, re-directs the air 52 into the ventilating means 40C. The duct 42 is in the form of a tube which conveys the fluid comprising air to the source of vacuum 40. The source of vacuum 40 serves a series or banks of chambers 36, each of which, in turn, cooperates with a series of drive belts 38 and which banks may be further described with reference to FIG. 3.

Figure 3:
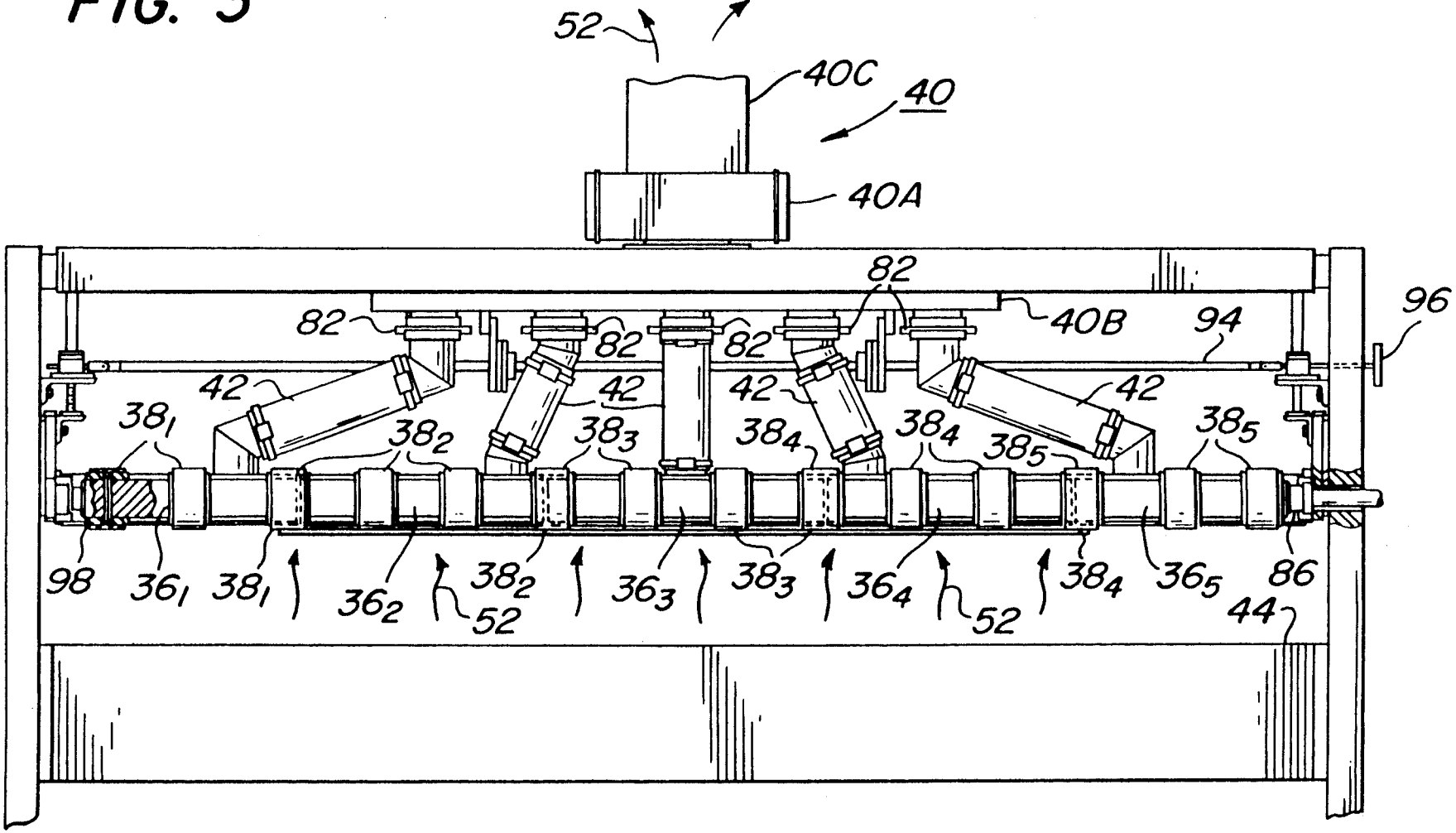
FIG. 3 illustrates further features of the vacuum belt top conveyor that accommodate various types and styles of boxes produced by the practice of the present invention.

FIG. 3 shows one embodiment of the present invention having the vacuum source 40 divided or shared between five chambers or housings $36_1$, $36_2$, $36_3$, $36_4$, and $36_5$. For the embodiment shown in FIG. 3, there are five chambers $36_1 \ldots 36_5$ and fourteen (14) belts $38_1 \ldots 38_5$. Various combinations of this arrangement and still further arrangements are contemplated by the practice of this invention. The chambers $36_1 \ldots 36_5$ are interconnected to the air chamber 40B by means of five separate vacuum ducts 42 and five separate slidable control means 82. The adjustable means 94 allows for the raising or lowering of the conveyor 22 so as to accommodate variations in the thickness of box blanks 24.

As shown in FIG. 3, the five chambers $36_1 \ldots 36_5$ are each arranged to cooperate with a plurality of belts $38_1 \ldots 38_5$ having the same subscript numbers. The plurality of belts $38_1 \ldots 38_5$ are arranged into groups which cooperate with respective banks. For example, chamber $36_1$ is arranged to cooperate with three belts each with the reference number $38_1$, covering a total distance which spans across the respective chamber $36_1$. Each of the respective chambers $36_1 \ldots 36_5$ shares at least one belt $38_1 \ldots$ or $38_5$. For example, chamber $36_1$ cooperates with its innermost belt $38_1$, which also serves as the outermost belt ($38_2$) that cooperates with chamber $38_2$.

Each of the belts, such as one of the outermost belt $38_1$, partially shown in section, is coupled to drive shaft 88 by means of device 98. The drive shaft 88 is interconnected to all of the drive belts $38_1 \ldots 38_5$.

In the operation of the box forming machine related to the present invention, the configuration of the chambers $36_1, \ldots 36_5$ and the belts $38_1 \ldots 38_5$ accommodates various dimensions associated with different types and styles of boxes that are formed by the machine. For example, as shown in FIG. 3, when an intermediate size box blank 24 is being run through the machine, the outside slide gates 82 for the two outermost chambers, such as $36_1$ and $36_5$, are closed so that all of the vacuum generated by the source of vacuum 40 is applied to the center chambers $36_2$, $36_3$ and $36_4$, thereby, providing for a more efficient use of the vacuum source 40. The use of the vacuum, generated by source 40, to attract and assist in the conveyance of box blank 24 by belts 38, may be further described with reference to FIG. 4.

Figure 4:
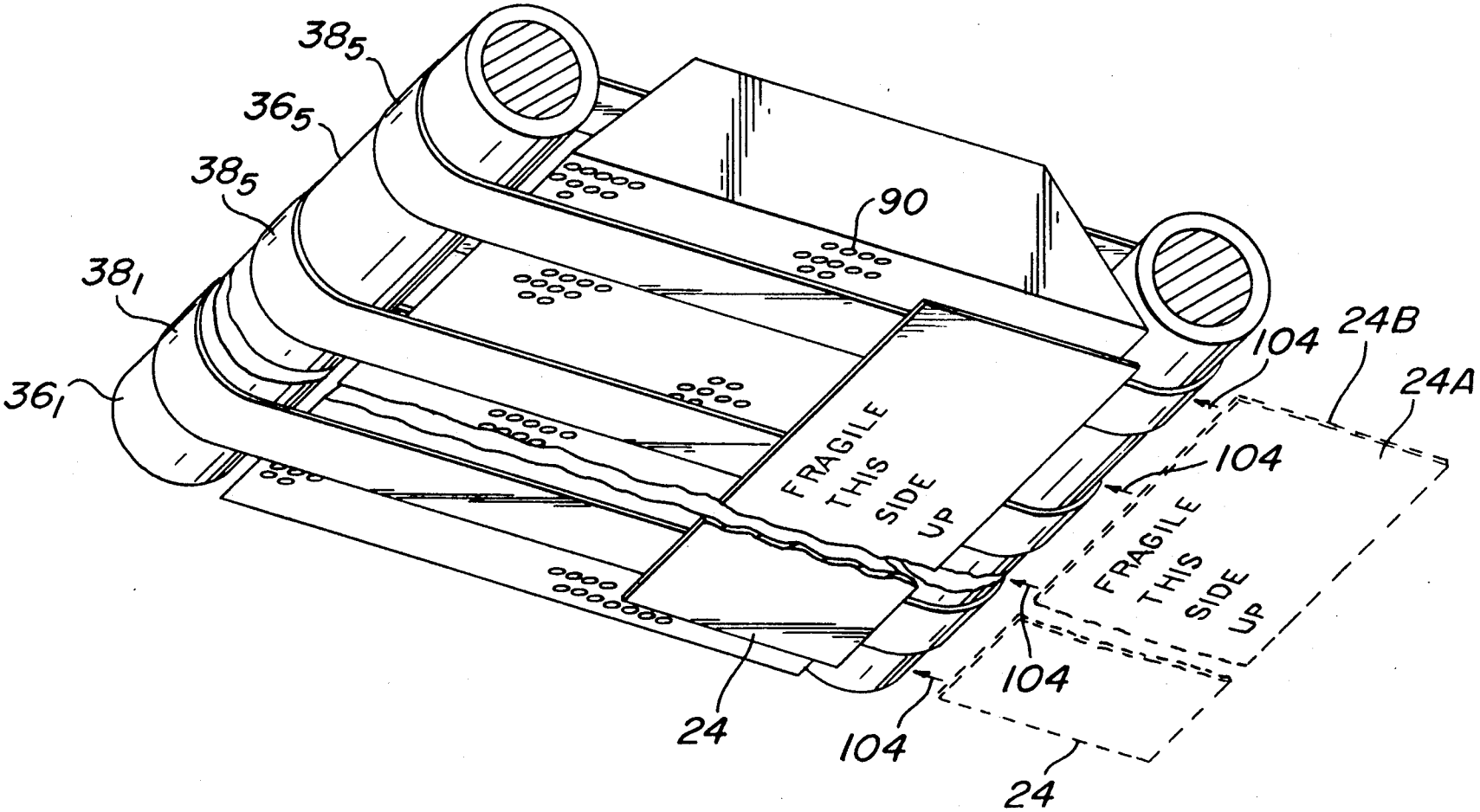
FIG. 4 is a schematic illustration of the operation of the vacuum belt top conveyor of the present invention.

FIG. 4 is a schematic illustration showing a portion of the bottom section of the vacuum belt top conveyor 22. FIG. 4 shows chambers $36_1 \ldots 36_5$ as having a bottom section with passageways 90 therein. The belts $38_1 \ldots 38_2$ are formed of a non-porous material, are not positioned over passageways 90, and preferably have a top surface with a high coefficient of friction so as to assist in the conveyance or movement of the box blank 24 by the belts $38_1 \ldots 38_5$.

FIG. 4 further shows the box blank 24 with two different illustrations, wherein the first is a solid representation and the second is a phantom representation. The solid representation of box blank 24 is shown as being mated to the undersurface of the vacuum top conveyor 22, whereas the phantom representation is shown as being spaced apart from the top conveyor 22. Both the solid and phantom representations of box blank 24 are shown to have printed matter such as, FRAGILE THIS SIDE UP, placed on the bottom surface 24A. The phantom representation of box blank 24 is shown to have a top surface 24B, whereas the top surface 24B is not shown for the solid representation of box blank 24.

In operation, the passageways 90 provide the means to establish a vacuum communication between the top surface 24B of box blank 24 and the source of vacuum 40 (see FIGS. 1 and 2). The vacuum causes the top surface 24B to be drawn, as shown by arrows 104 of FIG. 4, toward the passageways 90 so that the blank 24 is attracted to and makes contact with the moving surfaces of drive belts $38_1 \ldots 38_5$. The printed matter 92 being in its wet state at the juncture in the machine forming process, is on the bottom surface 24A, and is not disturbed by either the attraction of the top surface 24B to the belts $38_1 \ldots 38_5$ or by any further conveyance and movement by belts $38_1 \ldots 38_5$. The belts $38_1 \ldots 38_5$ further convey the box blank 24 onto the die cutting station 18, shown in FIG. 1, wherein the cutouts of the box, as previously discussed, are removed in a clean, sharp manner without distorting the printing matter on the bottom surface 24A of the blank box 24. This non-distorted printed matter provides an aesthetically pleasing effect to any person that may later be viewing or handling this same box.

It should now be appreciated that the practice of the present invention provides for a system wherein the printed matter is placed onto a box and does not encounter any smearing (drying station) or distortion (die cutting station) thereof.

It should be further appreciated that the practice of the present invention provides for a vacuum belt top conveyor that is easily adjustable and accommodates (see FIG. 3) the formation of different styles or types of boxes.

The present invention may be embodied in other specific forms without departing from the spirit or essential attributes thereof and, accordingly, reference should be made to the appended claims, rather than to the foregoing specification, as indicating the scope of the invention.

What is claimed is:

1. In a machine for forming a box from a blank having a top and a bottom surface, said machine including feed, print, dryer, die cutter and stacker sections, located along a predetermined path of movement of said blank said machine comprising:

(a) means for feeding said blank into said print section along said predetermined path;

(b) means within said print section for accepting said blank and placing printed matter on the bottom surface of said blank while said blank moves along said predetermined path and on its way to said dryer section;

(c) means for attracting the top surface of said imprinted blank to said overhead conveying said overhead conveying an overhead means within said dryer section, and means said overhead conveying means, continuing the movement of said blank along said predetermined path and on its way to said die cutter section;

(d) means within said die cutter section for accepting said blank and for forming cutouts in said blank, said cutting means comprising a first and a second roller with the first roller having an extension for cutting into said blank and the second roller having a soft surface to allow said extension to thereby penetrate, said first and second rollers respectively contacting said top and bottom portions of said blank.

2. In a machine according to claim 1, wherein said attracting and conveying means are arranged to cooperate with a source of heating for drying said printed matter, said heating source being located below the bottom surface of said blank as it is being moved by said overhead conveying means.

3. In a machine for forming a box according to claim 1, wherein said overhead conveying means has a surface with a high coefficient of friction.

4. In a machine for forming a box according to claim 1, wherein said overhead conveying means comprises a plurality of belts each being on a non-porous material.

5. In a machine for forming a box according to claim 4, wherein said attracting means comprises a chamber positioned under said conveying means, said chamber having passageways in its bottom section for communicating a vacuum to said top surface of said blank.

6. In a machine for forming a box according to claim 5, wherein said plurality of belts and chambers have an arrangement comprising:

(a) said chambers being segmented into a series of banks with each bank having said bottom section with said passageways and a top section, each of said banks having flow means connected to the top section of the chamber for allowing the passage of air outward from within the bank and onto said source of vacuum, or for preventing said air from exiting said bank; and (b) said plurality of belts being segmented in groups that span between respective banks of said chambers, each of said respective bank sharing at least one belt of another group.

7. In a machine for forming a box according to claim 6, wherein each of said plurality of belts are not positioned over said passageways of said chambers.

8. In a machine for forming a box according to claim 6, wherein said flow means comprises a flexible tube for conveying fluid comprising air to said source of vacuum, said tube having a first and a second end, said first end located on and connected to said top section of said bank, said second end being connected to said source of vacuum and having slidable blocking means to allow or prevent air from leaving within said bank or exiting therefrom.

9. In a machine for forming a box according to claim 1, wherein said means for accepting said blank and placing printed matter on the bottom surface of said blank comprises:

(a) pull rollers which accept said blank and continue its movement into and between an impression roller and a print roller;

(b) said impression roller and said print roller respectively contacting the top and bottom surface of said blank, said printer roller further contacting an ink roller which, in turn, cooperates with a doctor roller; and whereby said printed matter is placed onto said bottom surface of said blank.

* * * * *